US005096464A

United States Patent [19]

Yamamoto

[11] Patent Number: 5,096,464

[45] Date of Patent: Mar. 17, 1992

[54] PROCESS FOR PREPARING AN ABRASIVE SHEET

[75] Inventor: Motokazu Yamamoto, Tokyo, Japan

[73] Assignee: Hi-Control Ltd., Hong Kong,

[21] Appl. No.: 536,965

[22] Filed: Jun. 12, 1990

[30] Foreign Application Priority Data

Jul. 6, 1989 [JP] Japan ..... 1-173165

[51] Int. Cl.[5] ..... B24D 3/00

[52] U.S. Cl. ..... 51/293; 51/295; 51/296; 51/298

[58] Field of Search ..... 51/293, 295, 296, 298

[56] References Cited

U.S. PATENT DOCUMENTS

| | | | |
|---|---|---|---|
| 3,976,525 | 8/1976 | Mednick | 51/298 |
| 4,544,376 | 10/1985 | Duran | 51/293 |
| 4,938,784 | 7/1990 | Murakami et al. | 51/296 |
| 4,997,460 | 3/1991 | Satake et al. | 51/293 |

*Primary Examiner*—William R. Dixon, Jr.
*Assistant Examiner*—Willie Thompson
*Attorney, Agent, or Firm*—Ladas & Parry

[57] ABSTRACT

A process for preparing an abrasive sheet having abrasive particles adhered on a base sheet in monolayer is disclosed, wherein mixed slurry of abrasive particles and binder adhesive is foamed, the foamed slurry is uniformaly painted on the base sheet, and foams formed in the slurry is broken by heating thereby to form the abrasive sheet having good flatness.

6 Claims, 3 Drawing Sheets

PROCESS FOR PREPARING AN ABRASIVE SHEET

TECHNICAL FIELD

The present invention relates generally to a process for preparing an abrasive sheet and more particularly to a process for preparing an abrasive sheet having abrasive particles adhered on a base sheet in monolayer so as to form the abrasive sheet having good flatness.

BACKGROUND ART

A prior art abrasive sheet is shown in FIG. 3 and is prepared by mixing and stirring abrasive particles, adhesive as a binder, e.g. a polyester resin and so on, and a hardener, uniformly painting and dry-hardening the mixture on a plastic base sheet, e.g. a polyester sheet and so on. 1 is the base sheet, 2 is the abrasive layer, 3 and 3*a* are abrasive particles and 4 is the binder.

In such an abrasive sheet which is manufactured by the prior art process, part 3*a* of the abrasive particles 3 which emerge from a surface of the abrasive layer 2 contribute to polishing, however, another of the abrasive particles are buried in the abrasive layer and never contribute to polishing.

Accordingly, some abrasive preparing processes to form a thin abrasive layer on a base sheet so that abrasive particles buried in the abrasive layer decrease are developed. However, for instance, when a thin abrasive layer is thinly formed on a base sheet so that abrasive particles are adhered on the base sheet in monolayer, as shown in FIG. 4, the flatness of the abrasive sheet is no good because of differences 5 among diameters of abrasive particles.

In another process for preparing an abrasive sheet using a roller (FIG. 5*a*) or a blade (FIG. 5*b*) in order to improve flatness of the abrasive sheet, larger abrasive particles 3'catch on the roller 6 or the blade 7, move together and damage a surface of the abrasive layer 4.

Because there are a way of densely heaping up abrasive particles on a sheet (FIG. 6*a*) and a way of simply heaping up abrasive particles on a sheet (FIG. 6*bl*) in forming a abrasive layer on a base sheet, as shown in FIG. 6, even if abrasive particles which are ideally all of the same size are used, a abrasive sheet with good flatness cannot be formed unless a abrasive layer is formed on a base sheet so that the thickness of the layer is several times a diameter of a abrasive particle, as shown in FIG. 3. Thus, in such a abrasive sheet, only part of the abrasive particles which emerge from a surface of the sheet only make contribution to polishing, another of the abrasive particles which are buried in the abrasive layer never make contribution to polishing. This causes increase in preparing cost, when expensive abrasive particles such diamond and so on are used as abrasive particles.

The present invention is directed to overcoming the shortcomings of the prior art as set forth above, therefore, an object of the present invention is to provide a process for preparing an abrasive sheet with a thin abrasive layer over which expensive abrasive particles such diamond are sparsely spread, and having good flatness.

SUMMARY OF THE INVENTION

The present invention relates to a process for preparing an abrasive sheet which has expensive abrasive particles such diamond sparsely spread and adhere to a plastic base sheet so that the abrasive sheet has good flatness and is characterized by that mixed slurry of abrasive particles and a resin adhesive as a binder is foamed and the foamed slurry is uniformaly painted on a surface of the plastic base sheet. In painting, the foamed slurry including abrasive particles may be relatively thick painted on the base sheet to form an uniform abrasive sheet with good flatness.

When foams formed in the slurry are broken by heating the painted sheet for a predetermined period or spraying an antifoaming agent on a surface of the slurry, a thin abrasive layer which has good flatness and over which abrasive particles are spread sparsely is formed on the base sheet, thus, the abrasive sheet of the present invention is prepared.

BRIEF DESCRIPTION OF THE DRAWING

The present invention will now be described in detail in connection with the attached drawings in which.

DETAILED DESCRIPTION OF THE PREFERRED EMBODIMENTS

The process for preparing a abrasive sheet of the present invention is shown in FIG. 1.

First, abrasive particles to be adhered to a abrasive sheet are heated more than one hour at a temperature of 100°~150° C. to remove water from the surfaces of the abrasive particles. Diamond, aluminium oxide, or silicon carbide having its average diameter from 0.3~40 μm is used as the abrasive particle. Then, these abrasive particles are mixed with a binder adhesive. The binder adhesive is preferably a polyester resin abrasive, but is not limited to it. In one embodiment, after 1 kilogram of diamonds (the diameter is 3 μm) are heated for one hour at a temperature of 100° C., the diamond are mixed with 1 kilogram of a saturated polyester resin.

A mixed solvent of toluene, xylene, ethyl acetate, and metyl ethyl ketone is stirred into the mixture until slurry of which viscosity is 500 cp is obtained. The slurry is filtered by a wire netting filter with a 5-μm mesh. Then, 7.5 gram of a isocyanate hardener and 10~20 gram of azodicarbonamide as a foaming agent depending on the situation are added to the slurry. Furthermore, a solvent having the same composite as said mixed solvent is gradually stirred to the slurry until the viscosity of the slurry falls to 60~150 cp.

In addition to azodicarbonamide, dinitrosopentamethylenetetramine, fatty acid monoglycerid, dodecyl sulfonate salt, cane sugar fatty acid ester, polyethylenglycolmonolaurylether, ammonium bicarbonate may be use as the foaming agent.

The slurry of which the viscosity falls is poured into a vat with a stirrer of which a bottom is provided with a plurality of nozzles. 1.1~1.2 atmospheric pressure of air is introduced into the slurry through the nozzles, so that the slurry is stirred and foamed.

Diameter of foam formed in the slurry are changed with the viscosity and temperature of the slurry, the diameter of the nozzle and the air pressure, however, it is possible to form foams with diameter from 0.2 μm to 5 mm. Then, the foamed slurry has ½~1/100 the density of the unfoamed slurry.

The diameter of the foam is preferably from 1 μm to 20 μm. Because if the diameter of the foam is more than 20 μm, flatness of a surface of the completed abrasive sheet is inadequate, and if less than 1 μm, it takes a long time for the foams to disappear.

Figure 1A:
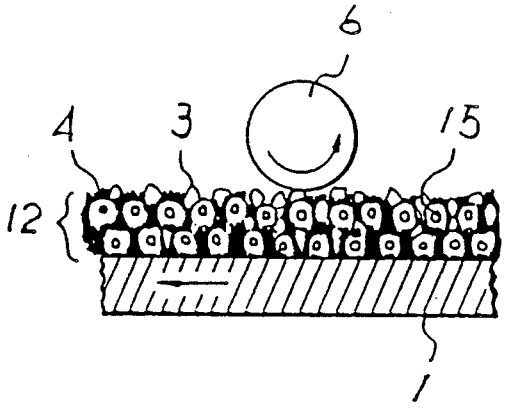
FIG. 1*a* is a view illustrating a foamed layer on a base sheet flattened by a roller in accordance with the present invention, the foamed layer being formed by painting a foamed slurry of a mixture of abrasive particles and a binder adhesive on the base sheet.
Figure 1B:
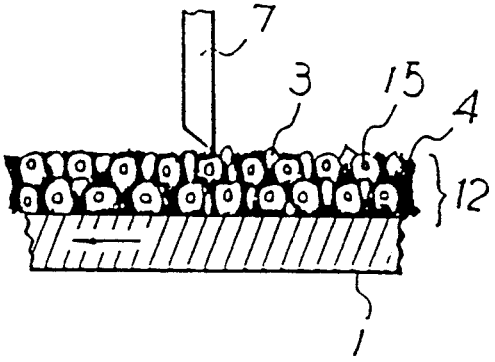
FIG. 1*b* is a view illustrating a foamed layer on a base sheet flattened by a blade in accordance with the present invention, the foamed layer being formed by painting a foamed slurry of a mixture of abrasive particles and a binder adhesive on the base sheet.

As shown in FIG. 1*a* and FIG. 1*b*, after the mixture of abrasive particles and binder adhesive is foamed, the mixture is uniformly painted on a base plastic sheet by a roller 6 or a blade 7 to form foamed layer 12 comprising abrasive particles 3, binder adhesive 4 and foams 15 having the thickness of 10~20 μm. The base plastic sheet is preferably a polyester sheet having the thickness of 16~150 μm.

In addition, dodecyl sulfondiethanlamid, dodecyldimethylamine oxid may be added to the slurry beforehand in order to stabilize the foams formed in the slurry.

Then, the painted sheet is heated at a temperature of 90°~100° C. for two minutes. In this process, the foams disappear. If the foams is hard to disappear, the foams easily break by spraying an antifoaming agent, e.g. methanol, dimethylpolysiloxane, lower alchol, mineral oil. As a result, the foams in the layer break, thin abrasive layer 2 which has good flatness is formed on the base sheet (See FIG. 1).

Figure 2:
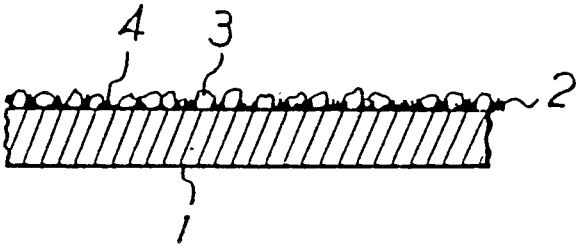
FIG. 2 shows the abrasive sheet of the present invention having abrasive particles spread sparsely, the sheet having good flateness.
Figure 3:
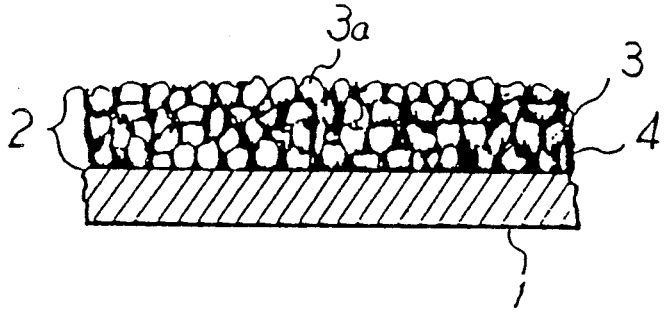
FIG. 3 shows a prior art abrasive sheet having abrasive particles buried in the abrasive layer, the abrasive particles making no contribution to polishing.
Figure 4:
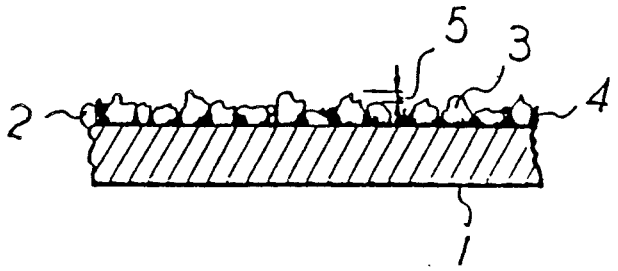
FIG. 4 shows a prior art abrasive sheet of which flatness is not good owing to abrasive particles in all size.
Figure 5A:
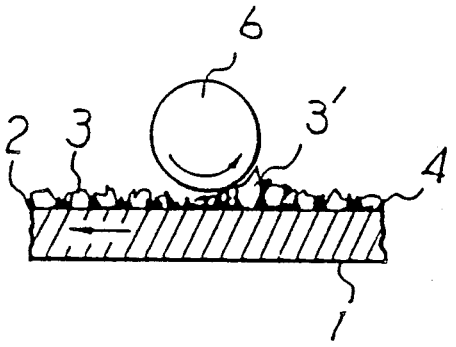
FIG. 5*a* is a view illustrating use of a roller for flattening a surface of an abrasive layer in a prior art process for preparing an abrasive sheet.
Figure 5B:
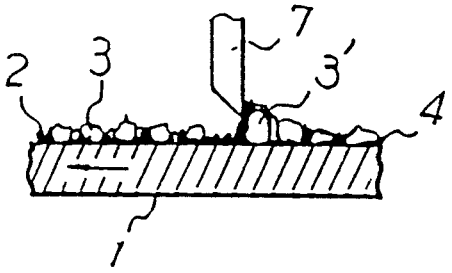
FIG. 5*b* is a view illustrating use of a blade for flattening a surface of an abrasive layer in another prior art process for preparing an abrasive sheet.
Figure 6A:
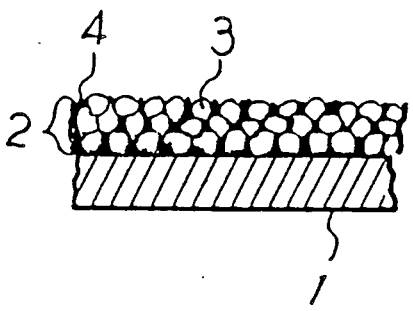
FIG. 6*a* shows an abrasive sheet having an abrasive layer which is densely heaped up.
Figure 6B:
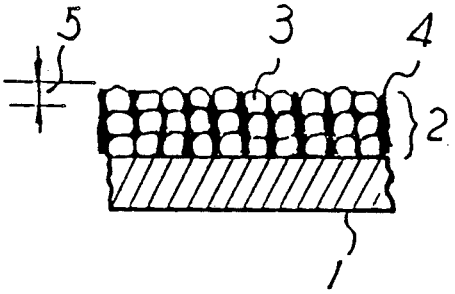
FIG. 6*b* shows an abrasive sheet having an abrasive layer which is simply heaped up.

The volume of the layer decreases with disappearance of the foams in the layer, thus, a thin abrasive layer is formed on the sheet and the abrasive particles are sparsely spread in monolayer over the sheet. Finally, the sheet is cured at a temperature 40°~180° C. for 5~12 hours, thus, the abrasive sheet of the present invention as shown in FIG. 2 is completed.

The abrasive sheet produced by the process of the present invention has a thin abrasive layer in which abrasive particles are sparsely spread, and which has good flatness. Therefore, abrasive particles which make no contribution to polishing decrease, the abrasive sheet preparing cost remarkably decrease when abrasive particle is diamond.

While there have been described and illustrated specific embodiments of the invention, it will be clear that variations in the details of the embodiments specifically illustrated and described may be made without departing from the true spirit and scope of the invention as defined in the appended claims.

What is claimed is:

1. A process for preparing an abrasive sheet comprising the steps of foaming a mixed slurry of abrasive particles and a binder adhesive and painting the foamed mixture on at least one side surface of a base sheet.

2. The process as in claim 1 wherein said step of foaming comprises a step of heating after adding a chemical foaming agent selected from a group consisting of azodicarbonamide, dinitrosopentamethylenetetramine, fatty acid monoglycerid, fatty ester, dodecyl sulfonate salt, cane sugar fatty acid ester, ammonium bicarbonate, polyethylenglycolmonolurylether to the mixed slurry of abrasive particles and binder adhesive.

3. The process as in claim 1 wherein said step of foaming comprises a step of introducing compressed air, compressed nitrogen gas or liquefied propane gas to the mixed slurry of abrasive particles and binder adhesive through nozzles.

4. The process as in claim 1 wherein a stabilizer selected from a group of consisting of dodecyl sulfondiethanlamid, and dodecyldimethylamine oxid is added in the slurry in order to stabilize foams formed in the slurry.

5. The process as in claim 1 wherein an antifoaming agent selected from a group consisting of methanol, dimethylpolysiloxane, lower alchol, and mineral oil is sprayed on a surface of the foamed slurry of abrasive particles and binder adhesive in order to break foams formed in the foamed slurry.

6. The process as in claim 1 wherein the binder adhesive is vinyl acetate resin emulsion if a piece of paper or cloth is used as a base sheet.

* * * * *